US008863904B2

(12) United States Patent
Schlecht

(10) Patent No.: US 8,863,904 B2
(45) Date of Patent: Oct. 21, 2014

(54) SCAFFOLD STRUCTURE

(75) Inventor: Barry Schlecht, Darby, MT (US)

(73) Assignee: System Concepts, LLC, Hamilton, MT (US)

( * ) Notice: Subject to any disclaimer, the term of this patent is extended or adjusted under 35 U.S.C. 154(b) by 749 days.

(21) Appl. No.: 11/234,584

(22) Filed: Sep. 23, 2005

(65) Prior Publication Data

US 2007/0068733 A1 Mar. 29, 2007

(51) Int. Cl.
*E04G 1/32* (2006.01)
*E04G 1/38* (2006.01)
*E04G 5/08* (2006.01)

(52) U.S. Cl.
CPC ... *E04G 1/38* (2013.01); *E04G 5/08* (2013.01)
USPC ..... 182/224; 182/227; 182/82

(58) Field of Classification Search
USPC ..... 182/224, 227, 82
See application file for complete search history.

(56) References Cited

U.S. PATENT DOCUMENTS

| | | | | | |
|---|---|---|---|---|---|
| 755,182 | A | * | 3/1904 | smyth | 182/224 |
| 1,597,555 | A | * | 8/1926 | Tolmie | 182/224 |
| 1,725,168 | A | * | 8/1929 | Willis | 182/225 |
| 2,272,957 | A | | 2/1942 | Walp | |
| 2,753,222 | A | * | 7/1956 | Foresta et al. | 182/224 |
| 2,966,957 | A | * | 1/1961 | Ireland | 182/224 |
| 3,098,540 | A | | 7/1963 | Hiner | |
| 3,250,344 | A | * | 5/1966 | Romano | 182/27 |
| 3,472,539 | A | * | 10/1969 | Fenwick | 403/171 |
| 3,850,264 | A | * | 11/1974 | Salinas | 182/178.3 |
| 4,078,633 | A | * | 3/1978 | Fahy | 182/82 |
| 4,179,090 | A | * | 12/1979 | Williams et al. | 248/235 |
| 4,640,385 | A | * | 2/1987 | Underhill | 182/113 |
| 4,823,913 | A | * | 4/1989 | Riegel, Jr. | 182/225 |
| 5,385,215 | A | * | 1/1995 | Williams et al. | 182/179.1 |
| 5,727,650 | A | * | 3/1998 | Thomas | 182/224 |
| 6,070,696 | A | * | 6/2000 | Chubb et al. | 182/227 |
| 6,712,182 | B1 | * | 3/2004 | Baker | 182/225 |
| 6,810,996 | B2 | * | 11/2004 | Rump | 182/186.5 |
| 6,983,824 | B1 | * | 1/2006 | Dandurand | 182/82 |
| 2002/0178683 | A1 | * | 12/2002 | Phillips | 52/651.1 |
| 2004/0016600 | A1 | | 1/2004 | Austin et al. | |
| 2010/0012427 | A1 | * | 1/2010 | Julliard | 182/82 |

OTHER PUBLICATIONS

Modern Language Association (MLA): "solid." Dictionary.com Unabridged. Random House, Inc. May. 20, 2013. <Dictionary.com http://dictionary.reference.com/browse/solid>.*

* cited by examiner

*Primary Examiner* — Katherine Mitchell
*Assistant Examiner* — Candace L Bradford
(74) *Attorney, Agent, or Firm* — Jean Kyle

(57) ABSTRACT

A lightweight, portable scaffold system has at least two support members which bear a platform. The support members have a Y-shaped base. Independently, adjustable legs attach to the arms of the Y and allow the support member to stand level on uneven ground. A support arm cantilevers from the stem of the Y. The support arm of each support member contacts a vertical surface and bears the platform. The scaffold structure is constructed of hollow stock to reduce its weight and can be dismantled and stored in a duffle bag.

14 Claims, 5 Drawing Sheets

SCAFFOLD STRUCTURE

BACKGROUND OF THE INVENTION

A boom in the home improvement industry has resulted in a flood of new products and information being released into the market directed at the do-it-yourselfer as well as the contractor. Home improvement enthusiasts are now tackling more complicated projects around the house. To complete any project safely it is important to have the proper tools. Painting or staining high walls and installing overhead lighting, crown molding or other ceiling detail requires a steady platform from which to work. High ladders can be unsteady as well as inconvenient because they offer little space for equipment and limit mobility. Ideally, for completing high projects, work is conducted on scaffolding. To work from the safety and convenience of scaffolding however a homeowner must rent a scaffolding system from an equipment rental store. Rented scaffolding consists of large steel frame members that are braced to support tiers of the scaffold. This scaffolding is heavy to transport, cumbersome to assemble and move and expensive to rent. Many attempts have been made to produce lightweight, portable scaffolding (U.S. Pat. Nos. 2,272,957; 3,098,540; 4,823,913; 6,070,696 and 6,712,182 B1: U.S. Patent Application Publications US 2002/0178683 A1 and US 2004/0016600 A1) but few alternatives to the traditional heavy, bulky scaffolding are available. A need remains for inexpensive, lightweight scaffolding that is easy to use and provides homeowners and contractors a safe, sturdy platform from which to work.

All patents, patent applications, provisional patent applications and publications referred to or cited herein, are incorporated by reference in their entirety to the extent they are not inconsistent with the explicit teachings of the specification.

BRIEF SUMMARY OF THE INVENTION

The subject invention involves scaffolding that is lightweight, portable and easy to assemble. The lightweight scaffolding is constructed of hollow stock and can be disassembled and stored in a convenient duffle bag. The scaffold structure has at least two support members that bear a platform. Each support member has a Y-shaped base. Height adjustable legs extend from the arms of the Y. A support arm cantilevers from the stem of the Y to contact a vertical wall surface. The support arms from each support member bear the platform of the scaffold.

DETAILED DESCRIPTION OF THE INVENTION

The scaffold structure of the subject invention is lightweight, sturdy and intended to be used by the do-it-yourselfer in addition to the contractor. The scaffold structure is easy to assemble and disassemble and is not cost prohibitive. Disassembled it stores conveniently in a duffle bag.

Figure 1:
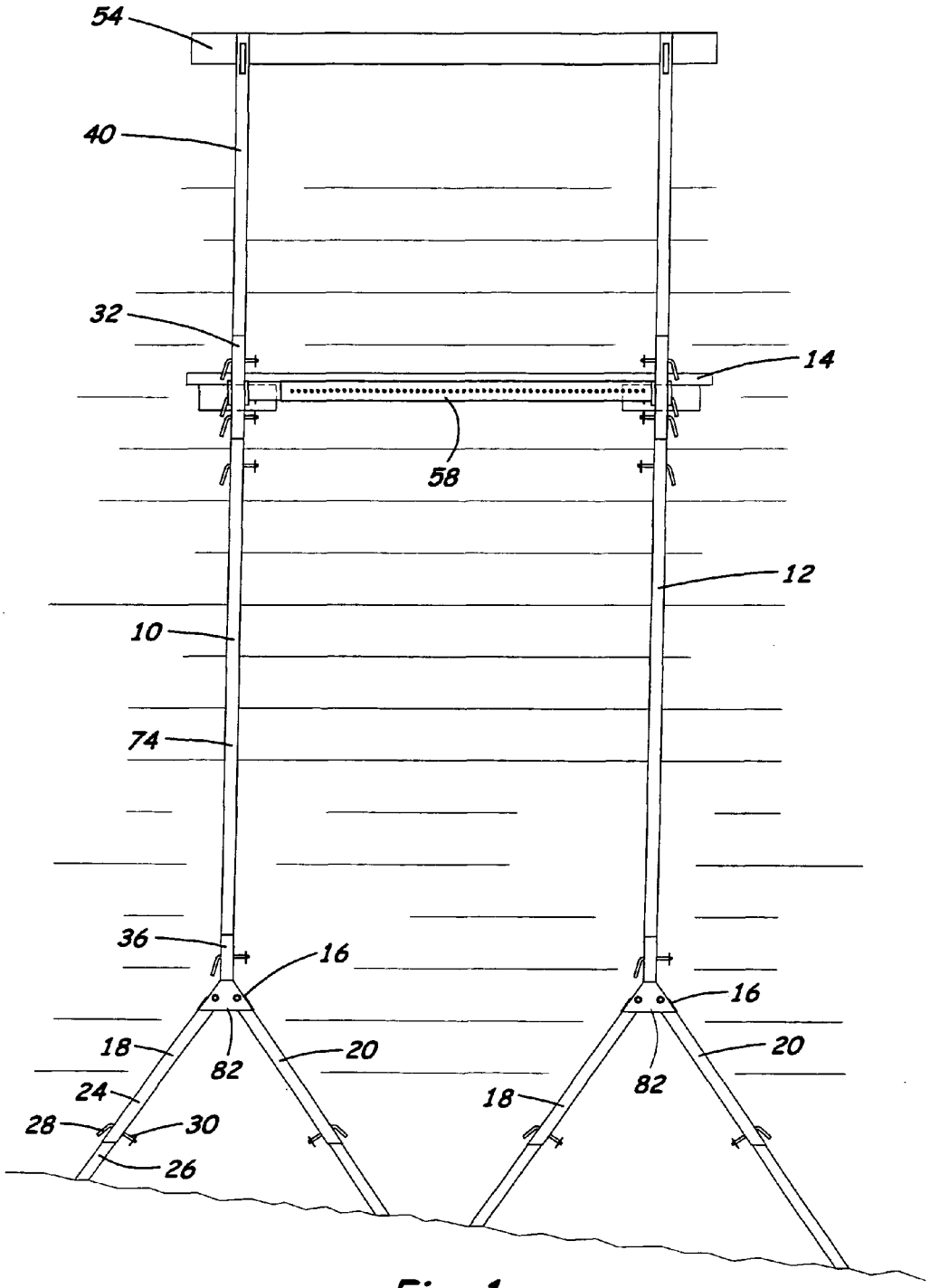
FIG. 1 is a front elevational view of a preferred embodiment of the scaffold structure of the subject invention in place against an exterior wall.
Figure 2:
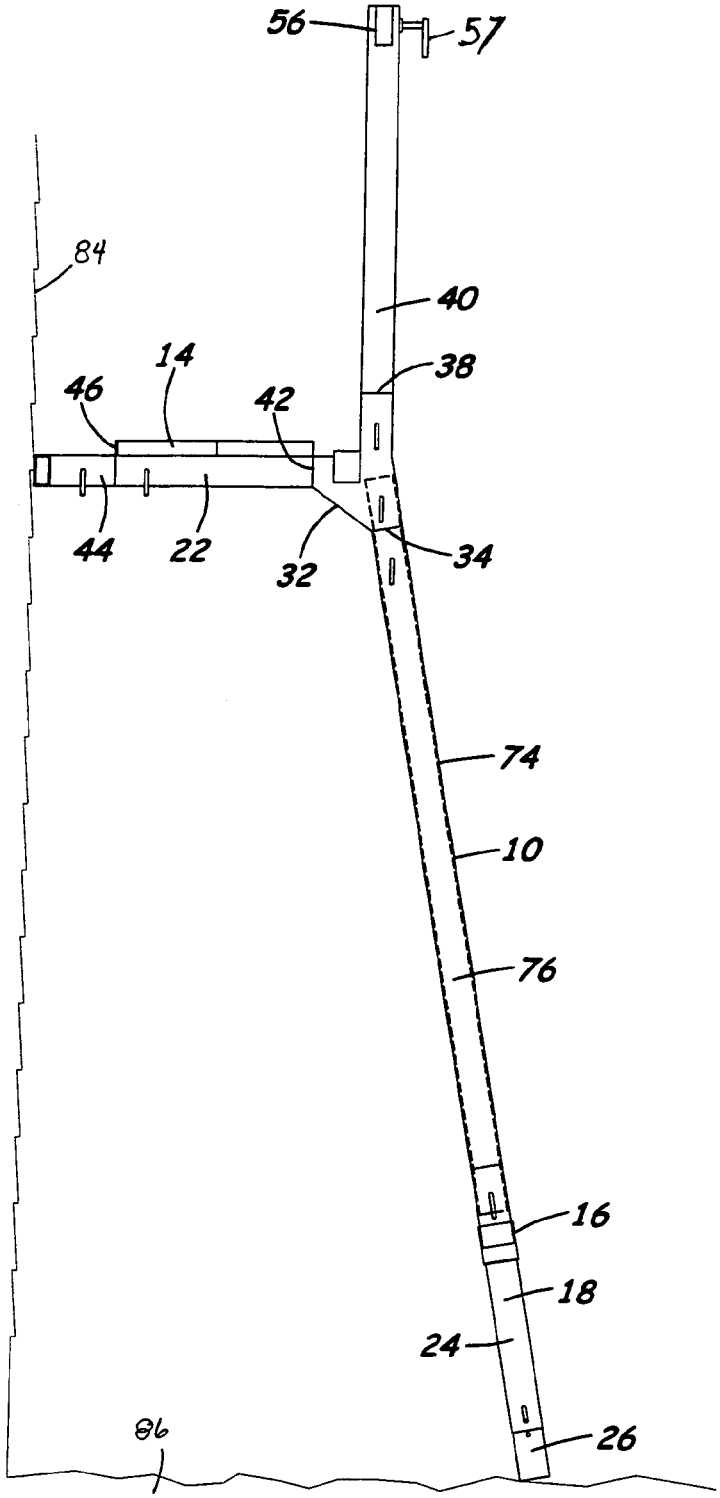
FIG. 2 is a side elevational view of the scaffold structure shown in FIG. 1.
Figure 3:
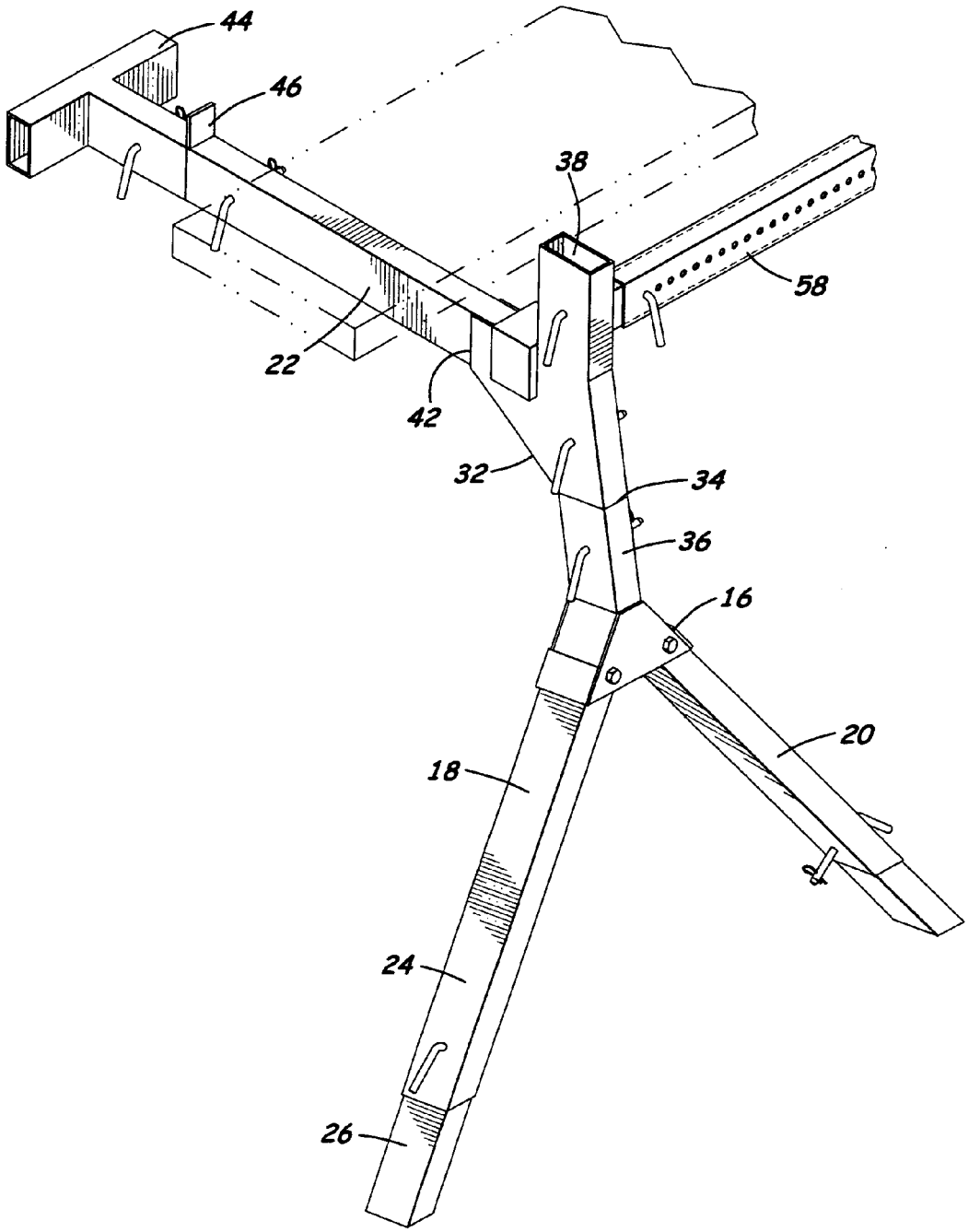
FIG. 3 is a partial perspective view of a preferred embodiment of a support member of the scaffold structure of the subject invention.

A preferred embodiment of the scaffold structure of the subject invention is shown in FIGS. 1-7. FIGS. 1 and 2 show the structure in place against a vertical surface 84 which is an outside wall. The scaffold structure comprises at least two support members 10, 12 that bear a platform 14. The support members have a base 16 which is moveably attached to two folding height adjustable legs 18, 20 and bears a support arm 22. The base 16 of the support member has a Y-shape. The arms of the Y receive height adjustable legs which extend to a horizontal ground surface 86. In the exemplified embodiment, the length of the legs are adjusted using telescoping members. An external leg member 24 is tubular and receives an internal leg member 26. The internal leg member 26 has measured apertures along its length. A pin 28 extends into a hole in one side of the external leg member 24 and through an aperture in the internal leg member 26 out an opposing hole in the external leg member and is locked in place with a cotter pin 30 or a similar locking device. The legs are independently height adjustable so that the scaffolding can be placed on uneven ground. It is noted that a base on which only one of the legs is height adjustable could also be leveled on uneven ground. The exemplified embodiment shows a simple, lightweight, cost effective means to make the legs of the scaffold system height adjustable. One skilled in the art would realize however that there are a number of suitable ways to provide height adjustable legs for the subject scaffold, including but not limited to, telescoping locking spring legs and adjustable screw feet.

A support arm 22 cantilevers from the tail of the Y-shaped base. In the exemplified embodiment, the support arm 22 extends from a support arm brace 32. The support arm brace 32 connects to the tail of the Y 36 of the base 16. The support arm brace 32 has three slots. One slot 34 receives the tail of the Y 36 of the base. An opposing slot 38 receives a rail support 40. Orthogonal to the rail support slot 38 is a slot 42 to receive the support arm 22. For maximum strength and stability, it is preferred that the support arm 22 is permanently, securely attached to the support arm brace 32 by, for example, welding. The support arm rests against the vertical surface or wall and the base and adjustable legs extend to the ground. The support arms of each support member provide a horizontal surface on which to rest the platform. It is noted that preferably, the support arm 22 projects from the tail of the Y 36 at an angle $\alpha_1$. Preferably, $\alpha_1$ is from about 95 degrees to about 110 degrees, and more preferably from about 100 degrees to about 105 degrees, and most preferably about 100 degrees. Providing the arm and base at this angle insures that the support member rests stoutly against the vertical surface 84 and offers a sturdy base for the platform. The exemplified support arm brace 32 is a convenient means by which to provide securement of the support arm to the base. Other suitable means to secure the support arm to the base would be apparent to those skilled in the art and can include, but are not limited to, a two slot brace or direct securement of the arm to the base through permanent means such as welding or by removable means such a nut and a bolt.

The support arm 22 extends from the support arm brace 32 to contact a vertical surface 84. In a preferred embodiment, an abutment member 44 contacts the surface. In the exemplified embodiment, the abutment member 44 has a T-shape to increase contact on the vertical surface. The T can have a protective coating applied or adhered thereto to protect the surface upon which it rests and/or increase friction with the vertical surface. A rubberized coating, for example, is soft and adds gripping power to the member. Other suitable coatings include, but are not limited to, TEFLON® and a microfiber fabric or fleece. One skilled in the art could identify other effective coatings for the abutment member as well as recognize other configurations for the terminal end of the support arm that would enhance surface contact.

The support arm 22 extends from the support member horizontally and bears the platform 14 of the scaffold of the subject invention. The support arm can be configured so its length from the support arm brace 32 to the abutment member 44 can be extended. In a preferred embodiment, an extension telescopes from within the support arm 22 and is affixed at the chosen distance with a pin and cotter pin.

A rail support 40 extends from the rail support slot 38 in the support arm brace 32 to bear a rail 54. The rail is an optional safety feature of the subject scaffold. A rail 54 can fit into a notch 56 at the end of the rail support distal from the support arm brace 32 to provide a safety rail for a person using the scaffold. A clamp 57 secures the rail 54 to the rail support 40.

Figure 5:
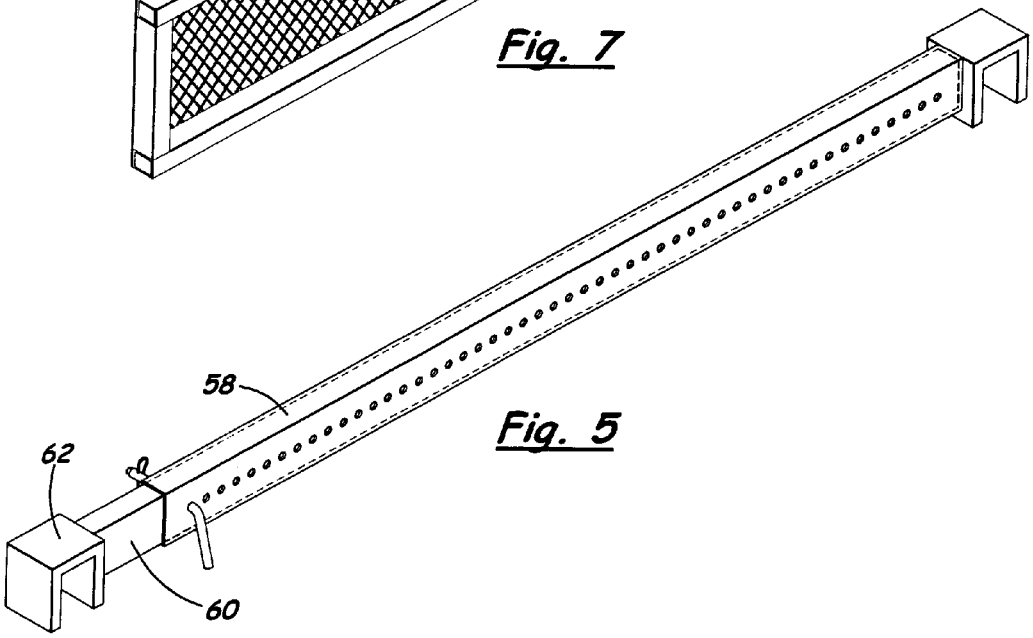
FIG. 5 is a perspective view of a preferred embodiment of a stabilizer bar for the scaffold structure of the subject invention.

To join and further stabilize the at least two support members a stabilizer bar 58 can be used (FIG. 1). The stabilizer bar 58 spans the distance between the support members. A preferred embodiment of the stabilizer bar is shown in FIG. 5. The bar 58 like other components of the scaffold of the subject invention has an internal extension member 60 with measured apertures to allow the length of the bar to be extended at measured increments. In the exemplified embodiment, the bar has saddles 62 at either end of the bar to rest upon the brace 32 of the support member 12. There are other suitable means by which the bar can engage and hold the respective support members, for example, the saddles could be notched into the bar or engage the bar from the side.

Figure 6:
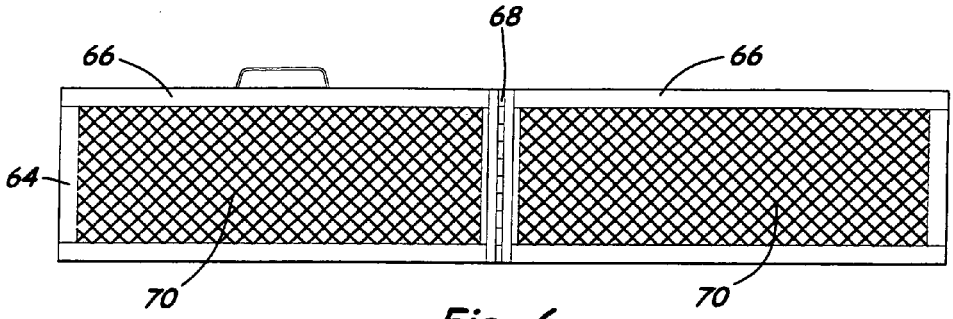
FIG. 6 is a side elevational view of a preferred embodiment of a platform for the scaffold structure of the subject invention.
Figure 7:
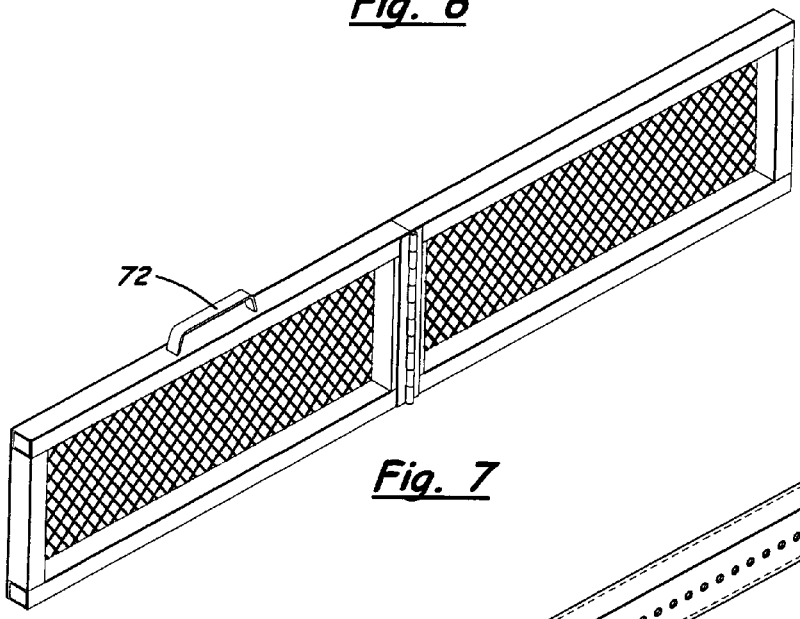
FIG. 7 is a perspective view of the platform shown in FIG. 6.

A platform 14 is supported by the support arms 22 of the support members 10 and 12. The platform 14 rests between the support arm brace 32 and/or stabilizer bar 58 and a platform stop 46. A simple 2×12 plank offers a rigid platform. A homeowner may use, for example, an eight foot 2×12 plank for the platform. A piece of timber this size however is heavy and difficult to maneuver and store. An alternative platform to a simple wood plank is shown in FIGS. 6 and 7. The subject platform 64 has two simple frames 66 hinged 68 together so the platform can be folded to reduce its length for storage. The frames are covered by a bearing surface 70. The bearing surface must be strong to support a person using the scaffold. Preferably, however, the surface is also lightweight to reduce the weight of the platform. A aluminum plating used as the bearing surface is sufficiently strong yet makes the platform a bit heavy. A aluminum mesh can be used as the bearing surface to provide adequate strength and reduce the weight of the platform. A handle 72 welded to one frame 66 allows the platform to be folded, latched and easily carried to a work site.

The height of the platform of the scaffold system of the subject invention can be as high as the base and legs or extended several times that height. An extension post 74 placed between the tail of the Y 36 and the support arm brace 32 adds height to the scaffold system. As seen previously, the height of the extension 74 can be further extended by an internal telescoping member 76. For practical use this member is used to extend the extension 74 the full distance of the extension. The internal member 76 can however have spaced apertures to allow adjustment to the height of the platform to be made in measured increments. The extension post 74 has a welded insert at its base which is received by the tail of the Y 36.

Figure 4:
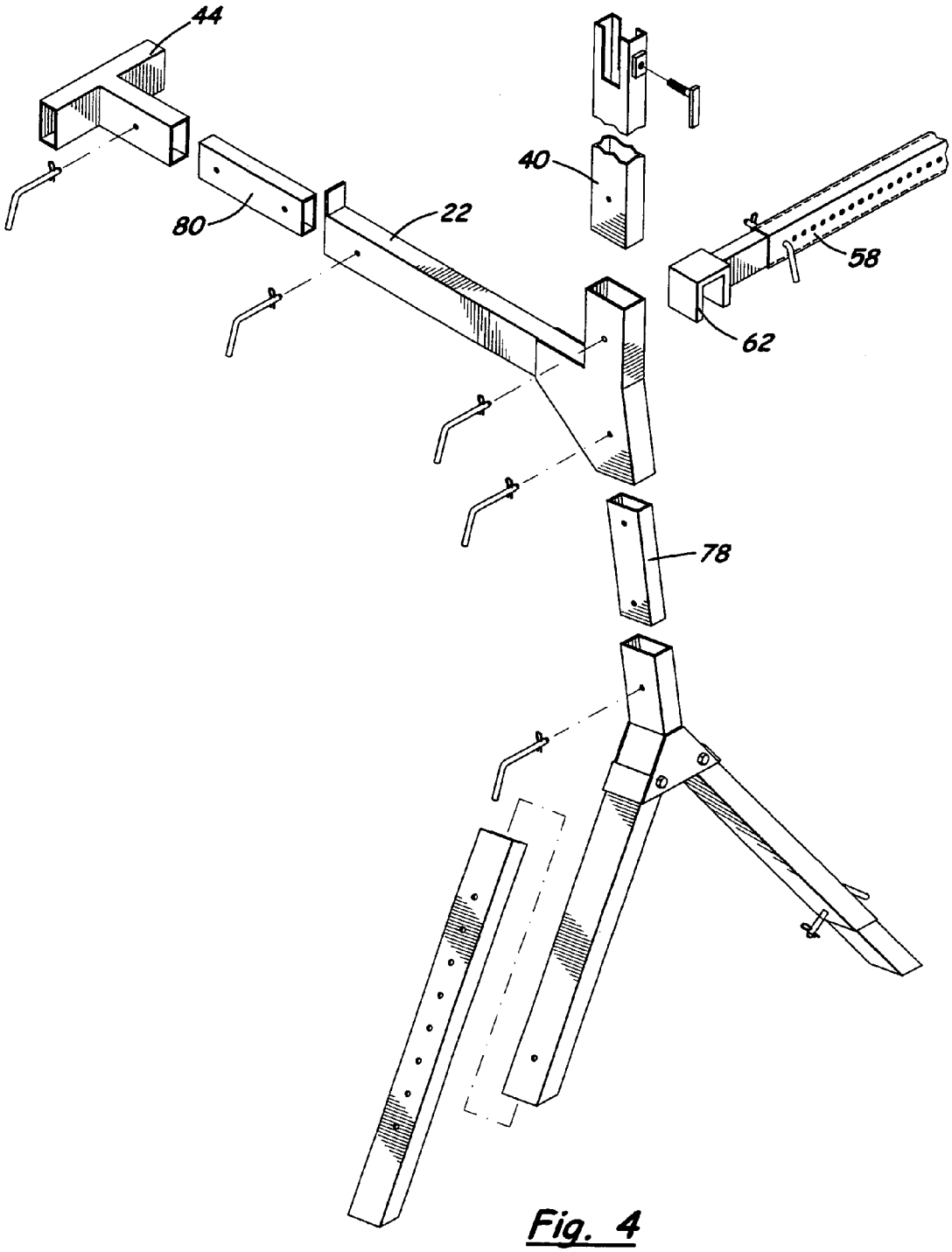
FIG. 4 is an exploded view of the embodiment of the support member shown in FIG. 3.

The subject scaffolding is easy to assemble and is intended to be used by the home improvement enthusiast and contractor. Pieces are assembled by like means whether or not extensions are used. For example, FIG. 4 shows that couplers 78, 80 are used to join the support arm brace 32 to the tail of the Y 36 and the support arm 22 to the abutment member 44. The couplers 78, 80 can be replaced by extension members to adjust the scaffolding. Most importantly, the extension members are fastened to adjoining pieces in the same manner as the couplers offering consistency to the owner and facilitating a safe and secure connection.

Since the scaffold is designed to be owned and used by the homeowner and contractor, it must be easy to store in a basement or garage. The subject scaffolding therefore breaks down into easy to manage, easy to store, pieces. The legs, for example, are foldable at the base and the support arm brace and support arm are removable from the base. In the exemplified embodiment, extending systems such as the legs, extension posts and stabilizer bar are telescoping allowing the extending pieces to be stored within the outer pieces. Each piece of the subject scaffold can be dismantled from the next and all pieces are easily stored in a duffle bag.

The subject scaffold system is assembled, for example, on the side of a house to be painted, by removing the base 16 pieces of each support member from the duffle storage bag (not shown). The height adjustable legs are folded out from each base member. Each leg of a single support member is adjusted in height to level the bottom 82 of the base 16 (see FIG. 1). The bases of other support members to be used in the scaffold system are likewise leveled and then each member is leveled to the other to provide a level support for the platform. Leveling each support member to the other is most easily done when the support arms are in place and the platform is resting on the support arms. Base members can first be adjusted with the platform at its lowest level. Adding extensions to the leveled bases to then raise the height of the platform should allow the platform to retain level.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A scaffold system comprising:

at least two support members, each support member comprising;

a one-piece Y-shaped base having a first arm, a second arm, and a tail rigidly joined at a junction, a first leg extending axially from an end of the first arm distal the junction of the Y-shaped base, a second leg extending axially from an end of the second arm distal the junction of the Y-shaped base, the first leg and the second leg extending to a horizontal ground surface, wherein at least one of the first leg and the second leg is adjustable, a support arm brace extending axially from an end of the tail distal the junction of the Y-shaped base the support arm brace comprising a first slot to connect the support arm brace to the end of the tail distal the junction of the Y-shaped base, a second slot wherein an angle between the first slot and the second slot is greater than 90 degrees and from about 95 degrees to about 110 degrees, and a third slot orthogonal to the second slot, and a support arm projecting from the second slot of the support arm brace wherein an end of the support arm distal the support arm brace rests on a vertical surface;

at least one stabilizer bar connecting the at least two support members above the Y-shaped base of each member; and a platform supported horizontally by the support arms of the at least two support members, wherein the platform is suspended between the support members which each contact the horizontal ground surface and the vertical surface.

2. The scaffold system of claim 1, wherein said support arm is securely attached to said brace.

3. The scaffold system of claim 1, said support arms of said at least two support members further comprises extension members.

4. The scaffold system of claim 1, wherein said support arms of said at least two support members further comprise T-shaped abutment members to contact said vertical surface.

5. The scaffold system of claim 1, wherein said at least one height adjustable leg of each support member comprises a first internal telescoping member which extends from an external telescoping member.

6. The scaffold system of claim 1, wherein each support member comprises two height adjustable legs.

7. The scaffold system of claim 1, wherein said platform is collapsible and comprises a first frame member supporting a bearing surface hingedly connected to a second frame member supporting a bearing surface.

8. The scaffold system of claim 1, wherein said angle between said first slot and said second slot is from about 100 degrees to about 105 degrees.

9. The scaffold system of claim 1, wherein said angle between said first slot and said second slot is about 100 degrees.

10. The scaffold system of claim 1, further comprising at least one rail support projecting from said third slot of said support arm brace of said at least two support members.

11. The scaffold system of claim 1, wherein said stabilizer bar is telescoping.

12. The scaffold system of claim 1, wherein said stabilizer bar connects one of said at least two support members to another of the at least two support members by attaching to the support arms of the at least two support members.

13. The scaffold system of claim 1, wherein at least one of said ends of said tail distal the junction of the Y-shaped base is connected to said support arm brace through an extension post of said at least two support members.

14. A height adjustable scaffold system comprising:

at least two support members, each support member comprising;

a one-piece Y-shaped base having a first arm, a second arm, and a tail rigidly joined at a junction, a first leg extending axially from an end of the first arm distal the junction of the Y-shaped base, a second leg extending axially from an end of the second arm distal the junction of the Y-shaped base, the first leg and the second leg extending to a horizontal ground surface, wherein at least one of the first leg and the second leg is adjustable, a support arm brace extending axially through an extension post from an end of the tail distal the junction of the Y-shaped base the support arm brace comprising a first slot to connect the support arm brace to the end of the tail distal the junction of the Y-shaped base, a second slot wherein an angle between the first slot and the second slot is greater than 90 degrees and from about 95 degrees to about 110 degrees, and a third slot orthogonal to the second slot, and a support arm projecting from the second slot of the support arm brace having a T-shaped abutment member at one end wherein an end of the support arm distal the support arm brace rests on a vertical surface;

a platform supported horizontally by the support arms of the at least two support members; and a stabilizer bar connecting the support arms of the at least two support members, wherein the height of the scaffolding system is adjusted by lengthening and shortening the extension posts between the end of the tail distal the junction of the Y-shaped base and the support arm brace, and wherein the platform is suspended between the support members which each contact the horizontal ground surface and the vertical surface.

* * * * *